US005161794A

United States Patent [19]

Adachi

[11] Patent Number: 5,161,794

[45] Date of Patent: Nov. 10, 1992

[54] SHEET CONVEYING DEVICE WITH AN OVERLOAD PROTECTION FEATURE

[75] Inventor: Nobukazu Adachi, Yokohama, Japan

[73] Assignee: Canon Kabushiki Kaisha, Tokyo, Japan

[21] Appl. No.: 713,283

[22] Filed: Jun. 11, 1991

[30] Foreign Application Priority Data

Jun. 20, 1990 [JP] Japan ..... 2-161541

[51] Int. Cl.[5] ..... B65H 5/06

[52] U.S. Cl. ..... 271/272; 198/781

[58] Field of Search ..... 271/116, 242, 270, 272, 271/274; 198/781

[56] References Cited

U.S. PATENT DOCUMENTS

| | | | |
|---|---|---|---|
| 4,337,935 | 7/1982 | Sawada et al. | 271/242 |
| 4,361,399 | 11/1982 | Sawada et al. | 271/242 |
| 4,621,802 | 11/1986 | Ishida et al. | 271/272 |
| 4,678,178 | 7/1987 | Akiyama et al. | 271/273 |
| 4,832,656 | 5/1989 | Rado | 198/781 |

FOREIGN PATENT DOCUMENTS

| | | | |
|---|---|---|---|
| 243758 | 10/1986 | Japan | 271/272 |
| 231726 | 9/1989 | Japan | 271/116 |
| 18244 | 1/1990 | Japan | 271/242 |

*Primary Examiner*—Robert P. Olszewski
*Assistant Examiner*—Steven M. Reiss

[57] ABSTRACT

A sheet conveying device includes a first rotating member for providing a sheet with a conveying force by rotating while contacting the sheet, a second rotating member for pressing the sheet against the first rotating member, a driving member for providing a driving force of a driving source, and a drive transmission for transmitting the driving force of the driving rotating member to the first rotating member. The drive transmission will produce a slip between the first rotating member and the driving rotating member when a load operating on the first rotating member is greater than a predetermined value.

11 Claims, 6 Drawing Sheets

SHEET CONVEYING DEVICE WITH AN OVERLOAD PROTECTION FEATURE

BACKGROUND OF THE INVENTION

1. Field of the Invention

This invention relates to a sheet conveying device for a copier, a printer or the like.

2. Description of the Related Art

In a conventional sheet conveying device, as shown in FIG. 12, transmission of the rotating drive force to a roller, such as conveying roller 101 or the like, is from an idler gear 108 to a conveying-roller gear 107, and further to a conveying roller 101.

The conveying-roller gear 107 is mounted on bearing unit 111 of the main body using bearing 110. As shown in FIG. 13, the conveying-roller gear 107 rotates in a counterclockwise direction, and the idler gear 108 rotates in a clockwise direction.

An end portion of the conveying roller 101 is subjected to D-cut, and the drive is transmitted via the D-cut surface.

In the above-described conventional device, however, if conveying roller 101 is overloaded due to jamming or the like, and thus a countervailing a force tending to stop the rotation exists, an immoderate force is applied from the idler gear 108 to the conveying-roller gear 107 in the direction P of the pressure angle of the gear. As a result, as shown in FIG. 13, a force pushing away from bearing unit 111 is applied to the conveying roller 101 in the direction Q, with the following disadvantages:

(1) The toothed surfaces of the gears are damaged.

(2) The conveying roller 101 tries to leave the bearing unit 111 of the main body, thus damaging the bearing unit 111 of the main body.

(3) The drive of a driving motor (not shown) in the main body is stopped.

SUMMARY OF THE INVENTION

It is an object of the present invention to prevent the damage of a conveying rotating member and a drive transmission means due to load when a sheet is jammed.

It is another object of the present invention to prevent the damage of a conveying rotating member and a drive transmission means due to load when an abnormal load is applied to the conveying rotating member.

In accordance with these objects, there is provided a sheet conveying device comprising a first rotating member for providing a sheet with a conveying force by rotating while in contact with the sheet and a second rotating member for pressing the sheet against the first rotating member. A drive member applies a driving force to the first rotating member and is connected thereto by a drive transmission for transmitting the driving force of the driving member to the first rotating member. The transmission produces a slip between the first rotating member and the driving member when the loading operation on the first rotating member exceeds a predetermined value.

DETAILED DESCRIPTION OF THE PREFERRED EMBODIMENTS

Figure 1:
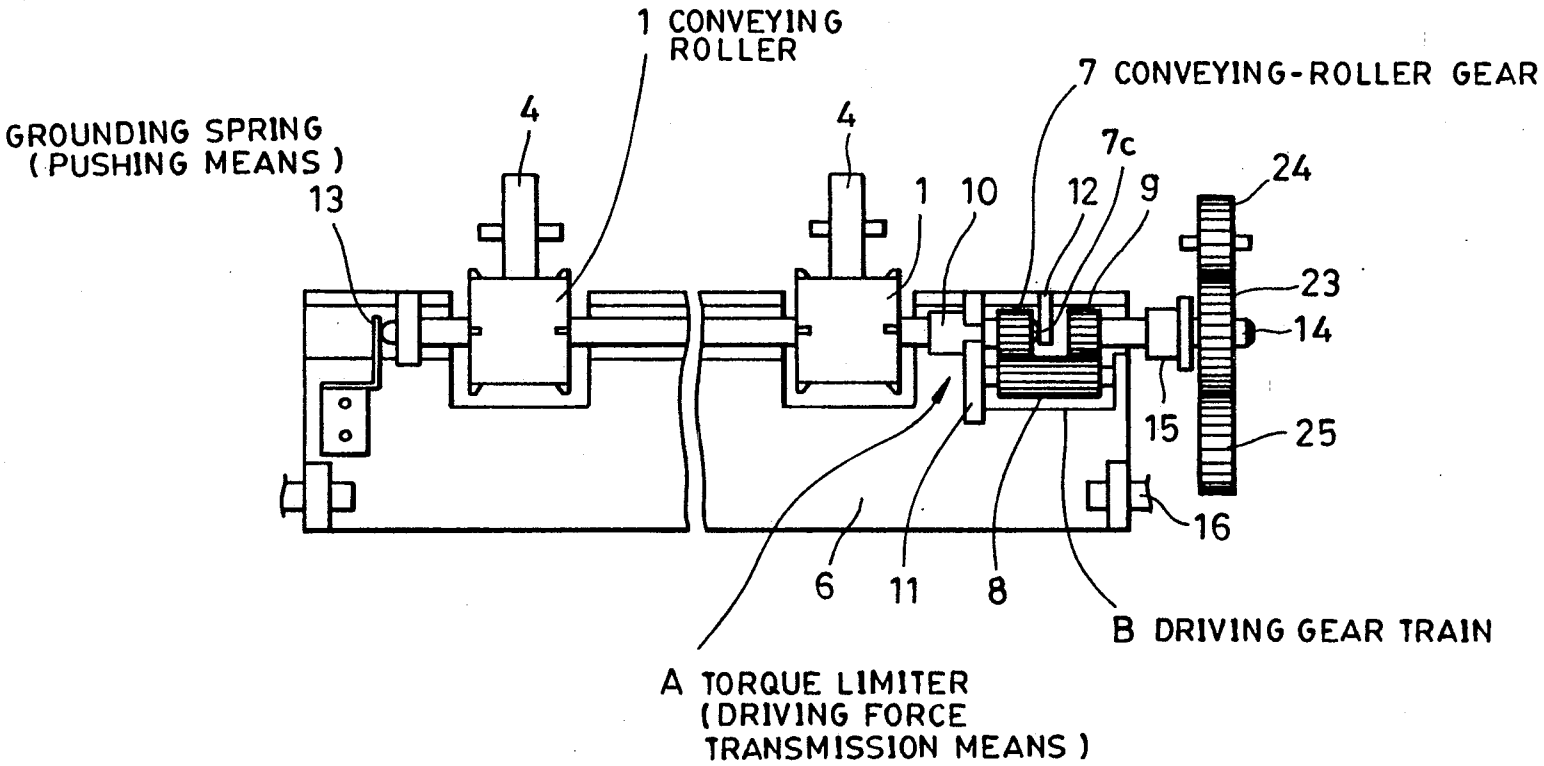
FIG. 1 is a cross-sectional view of a sheet material conveying device according to an embodiment of the present invention.

FIG. 1 is a cross-sectional view of a sheet material conveying device according to a preferred embodiment of the present invention.

In FIG. 1, a conveying roller 1 guides a sheet material on which an image is fixed to a conveying unit (not shown). A roller 4 is pressed against the conveying roller 1. The sheet material is conveyed while being grasped between the roller 4 and the conveying roller 1. A conveying cover 6 supports the conveying roller 1, and can be opened and closed. A conveying-roller gear 7 transmits a drive force to the conveying roller 1. An idler gear 8 transmits the drive force to the conveying-roller gear 7. A driving gear 9 drives the idler gear 8. The conveying-roller gear 7, the idler gear 8 and the driving gear 9 constitute a driving gear train B. A bearing 10 for the conveying roller 1 holds conveying roller 1 in position when the conveying roller 1 is assembled in the conveying cover 6. A bearing unit 11 for the idler gear 8 and the conveying roller 1 are formed integral with the conveying cover 6. A stopper 12 contacts the conveying-roller gear 7. A grounding spring 13, serving as a pushing means for pushing conveying roller 1 toward conveying-roller gear 7 (toward the right in FIG. 1), connects the conveying roller 1 to the ground of the main body using a contact (not shown). There are also shown a driving shaft 14 for the driving gear 9, a bearing 15 for the driving shaft 14, a fulcrum 16 for opening and closing the conveying cover 6, and gears 23, 24 and 25 in the main body. The gear 23 is a transmission gear which is rotatably driven by a motor of the main body to transmit the drive to the conveying roller 1.

The gear 25 is a transmission gear which meshes with the gear 23. The gear 24 is driven by the gear 23 to transmit the drive to another conveying roller which is put at downstream of the conveying roller 1.

Figure 2:
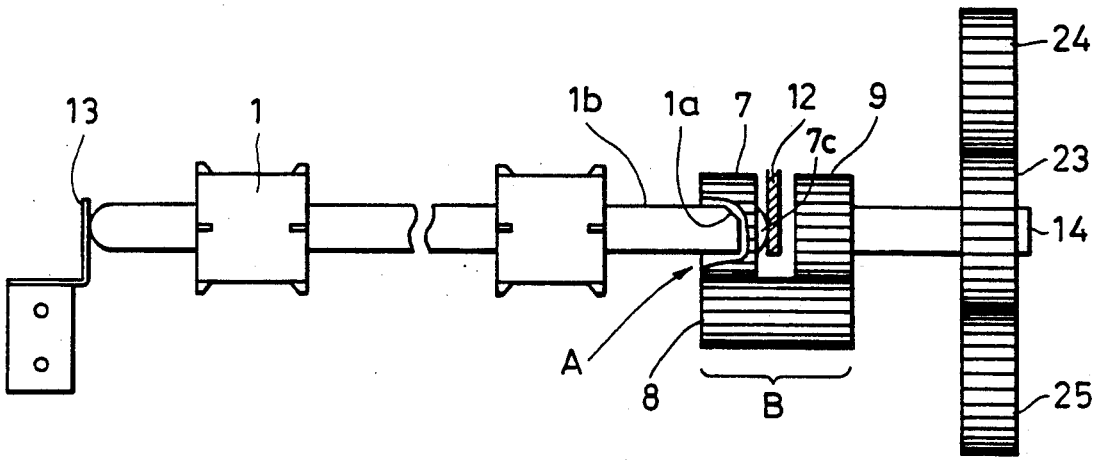
FIGS. 2 and 3 are detailed views of a driving unit of the device of FIG. 1.
Figure 3:
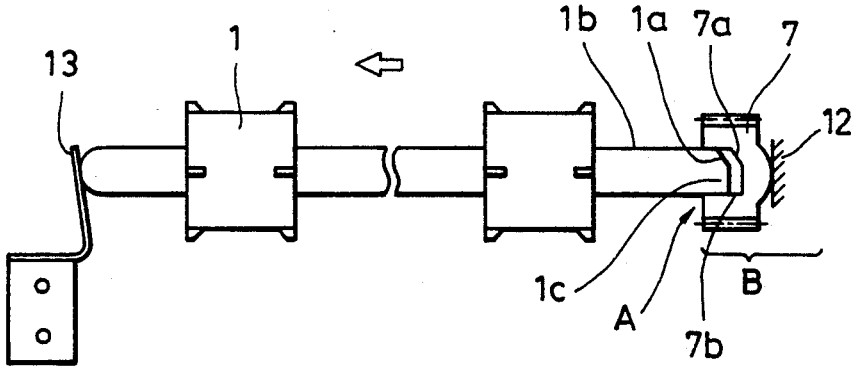

As shown in FIG. 2, and end portion of the conveying shaft **1*b* is chamfered, and a tapered surface 1*a* of the end portion engages the inner surface of the conveying-roller gear 7. Thus, the conveying roller 1 and the conveying-roller gear 7 constitute a torque limiter A, serving as a driving force transmission means. The conveying roller 1 is pushed toward the right, as shown in FIG. 1, by grounding spring 13, forcing end 7*c* of conveying-roller gear 7 against the stopper 12. When the conveying-roller gear 7 is driven, the drive is transmitted to the conveying roller 1 according to the engagement between the tapered surface 1*a* of the shaft 1*b* and the inner surface 7*a* of the conveying-roller gear 7. As shown in FIG. 3, when a load is applied to the conveying roller 1, the tapered surface 1*a* moves towards the left in FIG. 3 to release the engagement of the tapered surface 1*a* with the inner surface of the conveying-roller gear 7, whereby the drive force is not transmitted to the conveying roller 1. At that time, the amount of deflection of the grounding spring 13** is increased.

Figure 4:
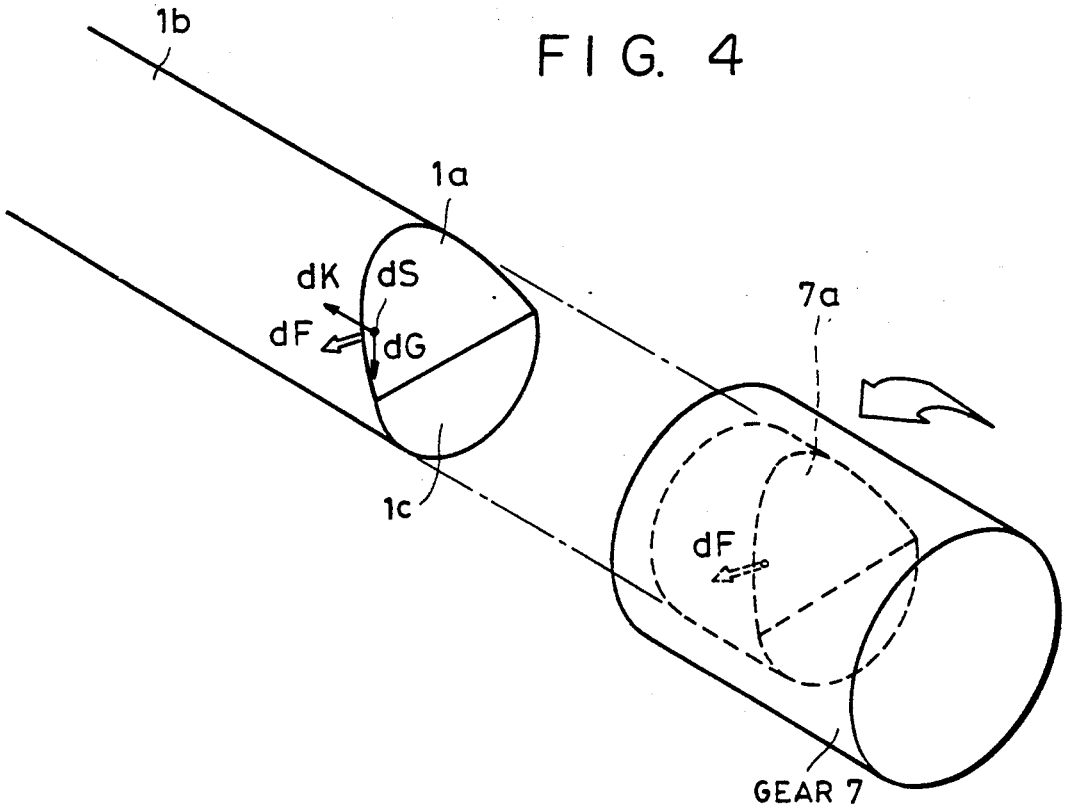
FIGS. 4–7 illustrate forces applied to principal portions.

The above-described phenomenon will be explained from the viewpoint of dynamics with reference to FIGS. 4 and 5. An end portion of the shaft 1*b* of the conveying roller 1 is loosely fitted slidably and rotatably in a hole 7*b* formed in the conveying-roller gear 7 and having a diameter approximately identical to the diameter of the shaft 1*b*. The hole 7*b* has an inclined surface 7*a* capable of being in surface contact with the tapered surface 1*a* of the shaft 1*b*. The tapered surface 1*a* is in pressure contact with the inclined surface 7*a* when the shaft 1*b* is pushed completely into hole 7*b* by the grounding spring 13. The driving force of the gear 7 is transmitted from the inclined surface 7*a* to the tapered surface 1*a*. In FIG. 4, the force which the point dS of the tapered surface 1*a* receives from the inclined surface 7*a* is represented by dF. The force dF is perpendicular to the slope of the tapered surface 1*a*. The force dF can be divided into a component dK which is parallel to the axis of shaft 1*b* and a component dG which is perpendicular to the axis of shaft 1*b*. A sum K+M, wherein K is an integral value represented by $K=\int dK\,dS$ of the component dK over the entire surface of the tapered surface 1*a* and M is a force which a non-tapered end surface 1*c* of the shaft 1*b* receives from the conveying-roller gear 7, balances with a force L by which grounding spring 13 pushes the shaft 1*b*. Hence, L=K+M. When the component dG is represented by a vector originating from the surface dS, the distance between the center O of the shaft 1*b* and the vector dG is represented by l. An integral value $T=\int l\,dG\,dS$ of the product of the distance l and the component dG over the entire surface of the tapered surface 1*a* represents a torque transmitted from the gear 7 to the shaft 1*b* (see FIG. 6).

If a large load is applied to the conveying roller 1 due to jamming or the like, a force $F=\int dF\,dS$ increases (it is assumed that the output of the motor for driving the conveying-roller gear 7 has a sufficient margin) in order to cope with the load, and the force K also increases.

Figure 7:
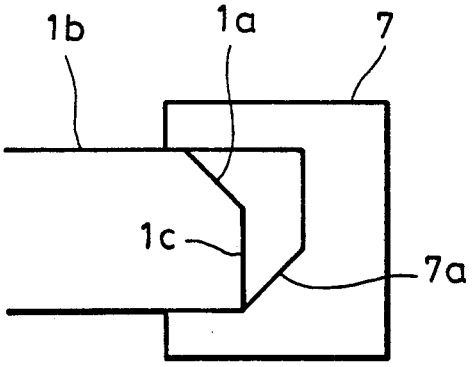

If L<M+K, or L<K when M=0, the shaft 1*b* moves in the direction of the axis against the force of the grounding spring 13. The pressure contact between the tapered surface 1*a* and the inclined surface 7*a* is disconnected and the end surface 1*c* rides on the inclined surface 7*a* (see FIG. 7). When this happens, the driving force is not transmitted from the conveying-roller gear 7 to the shaft 1*b*, and the gear 7 races while receiving the shaft 1*b*. The state shown in FIG. 5 is provided again after one revolution of the gear 7. However, if the gear 7 continues to rotate, the end surface 1*c* continues to ride on the inclined surface 7*a*, whereby the gear 7 continues to race.

Figure 8:
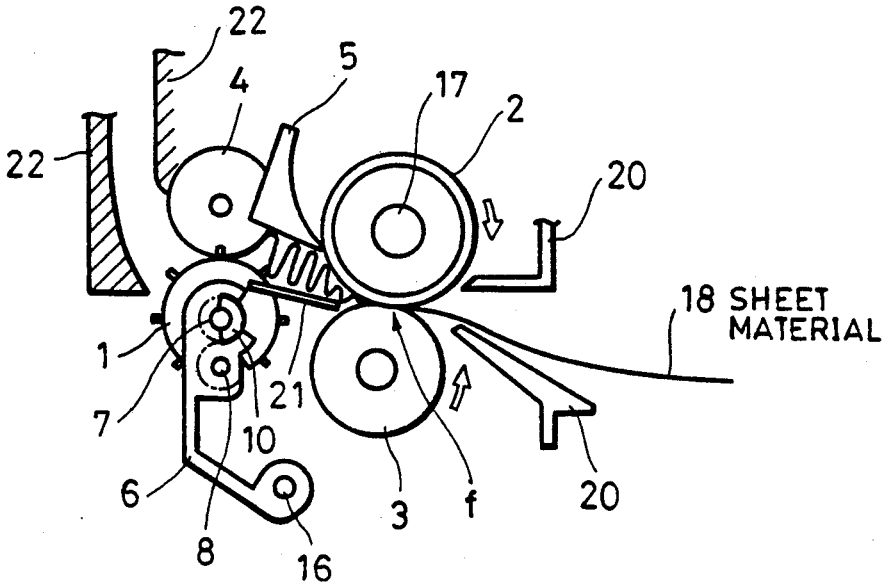
FIG. 8 is a cross-sectional view of a sheet material conveying apparatus in a state when a sheet material is jammed.

FIG. 8 illustrates the situation where a sheet material has jammed in the above-described configuration. A sheet material 18 on which toner is transferred by a transfer unit (not shown) is guided between a fixing roller 3 and a pressing roller 2 by inlet guides 20. The pressing roller 2 is rotated by a shaft 17 of the pressing roller, and the sheet material 18 on which an image is fixed by the fixing roller 3 is separated from pressing roller 2 by a separation pawl 5. The sheet material 18 is guided and grasped between the conveying roller 1 and the roller 4 by a guide 21. The sheet material 18 is then guided toward a discharge unit (not shown) by conveying guides 22. As sheet material 18 passes through fixing unit f it is apt to jam at the outlet of the fixing unit f. A number of causes are possible. For example, jamming may result from the sheet material 18 winding around the fixing roller 3 due to heat or from curling of the front end of the sheet material 18. As a result, as shown in FIG. 8, accordion jamming is produced in some cases. At that time, en exessive load is applied to the conveying roller 1 by the sheet material 18 having accordion jamming.

Figure 5:
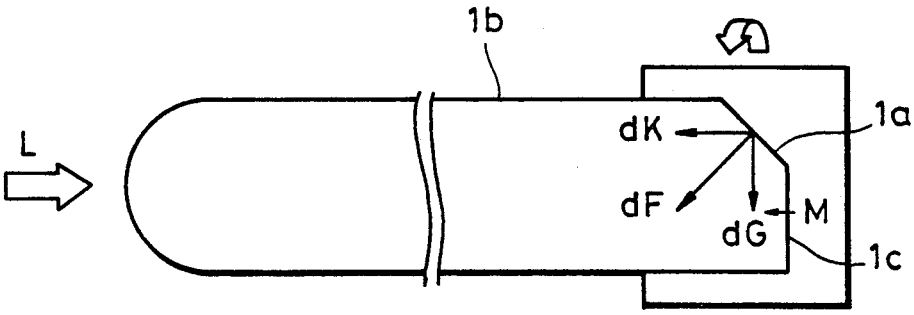
Figure 6:
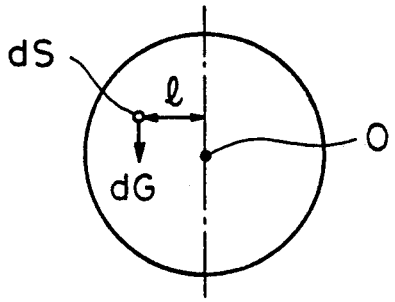

As shown in FIG. 5, the conveying roller 1 receives a force dK in a direction towards the left and away from the tapered surface 1*a* while it is driven by the conveying-roller gear 7. If the force exceeds the force L of the grounding spring 13 in a direction toward the right, the engagement of the conveying roller 1 with the conveying-roller gear 7 is disconnected, whereby the conveying roller 1 stops. Since the force L is applied to the conveying roller 1 by the grounding spring 13, the conveying roller 1 shifts to the right after one revolution of the conveying-roller gear 7, and the tapered surface 1*a* reengages the inclined surface 7*b*. However, since an overload is applied to the conveying roller 1, a force dK urging the conveying roller 1 toward the left is applied again from the tapered surface 1*a*, whereby the conveying roller 1 shifts left and its rotation stops.

Even though rotation of the conveying roller 1 is stopped because of the jam of the sheet material 18, the drive of the gears 23, 24 and 25 of the main body is not influenced. Hence, discharge rollers (not shown) convey a sheet material irrespective of the drive of the conveying roller 1.

Since the transmission of the drive between the conveying roller 1 and the conveying-roller gear 7 is performed using the tapered surface 1*a* of the end portion of the conveying roller 1, components for providing the torque limiter A are unnecessary. Hence, it is possible to simply perform torque control without increasing the cost.

Figure 9:
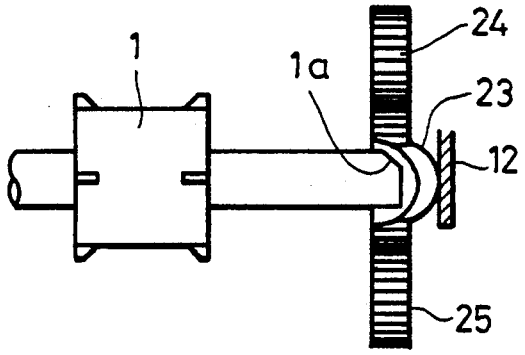
FIGS. 9–11 are views of other embodiments of the present invention.

In the present embodiment, since the conveying roller 1 is assembled integral with conveying cover 6 which may be opened and closed when removing a jam, the drive is transmitted via the idler gear 8. However, if it is not required to open and close the conveying cover 6 when removing a jam, the conveying roller 1 may be directly engaged with the gears 23, 24 and 25 of the main body (see FIG. 9).

Figure 10:
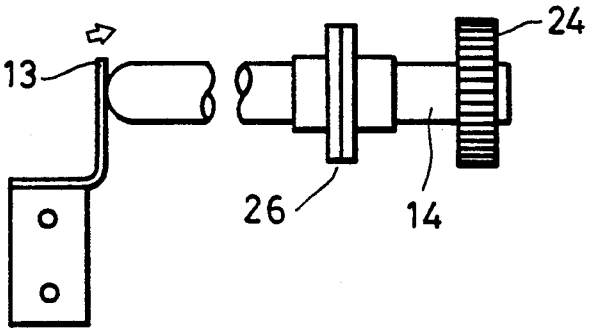

Although, in the first embodiment, the torque limiter A is configured by engaging the tapered surface 1*a* of the conveying roller 1 with the inner surface of the conveying-roller gear 7, disks 26 may be provided for transmitting the drive using a frictional force produced when the disks 26 are pressed against each other. Such an embodiment is depicted in FIG. 10. Alternatively, magnets may be provided in place of the disks 26 in order to transmit the drive force using a magnetic force.

Figure 11:
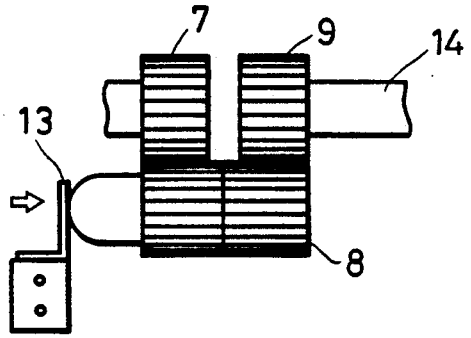
Figure 12:
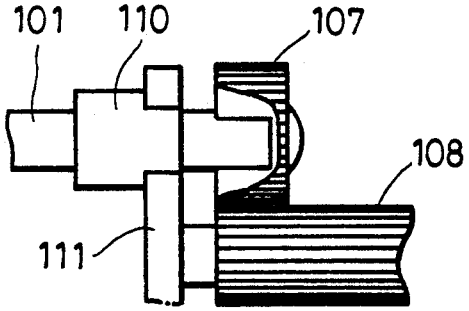
FIG. 12 PRIOR ART
FIGS. 12 and 13 are schematic cross-sectional views of a conventional device.
Figure 13:
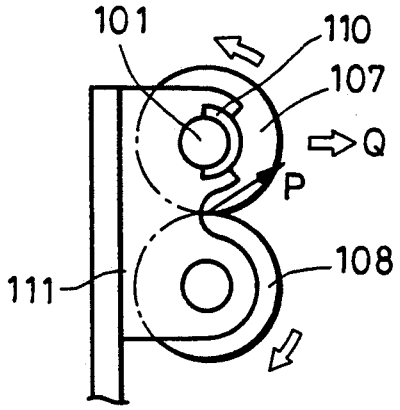
FIG. 13 PRIOR ART

Furthermore, the torque limiter may be configured using the idler gear 8 (see FIG. 11).

As explained above, by providing a torque limiter in a driving force transmission means, even if an overload is applied to the driving force transmission means due to jamming or the like, the driving force transmission means is not damaged, and also a bearing unit and the like are not damaged.

Since the torque limiter is provided in the driving force transmission means, even if a conveying roller stops, other kinds of drive, such as for discharging sheets, rotating a drum and the like, are not influenced. Hence, for example, a sheet material being discharged may detect jamming and may be discharged to the end irrespective of the drive of the conveying roller.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet conveying device comprising:

a first rotating member for providing a sheet with a conveying force by rotating while in contact with the sheet;

a second rotating member for pressing the sheet against said first rotating member;

a driving member for applying a driving force to said first rotating member;

a first surface rotating around a predetermined rotation axis in synchronization with said first rotating member, and inclined relative to a plane normal to said predetermined rotation axis;

a second surface rotating around said predetermined rotation axis in synchronization with said driving member, and inclined relative to a plane normal to said predetermined rotation axis; and pushing means for pushing said first surface against said second surface wherein a slip between said first rotating member and said driving member occurs when a load operating on said first rotating member exceeds a predetermined value.

2. A device according to claim 1, wherein said driving member and said first rotating member rotate around said predetermined rotation axis.

3. A device according to claim 2, wherein said first surface is formed at an end portion of said first rotating member.

4. A device according to claim 3, wherein said pushing means comprises a spring member for pushing an end of said first rotating member opposite to the end on which said first surface is located.

5. A sheet conveying device comprising:

a conveying rotating member for providing a sheet with a conveying force by contacting the sheet;

a shaft for rotatably supporting said conveying rotating member and having a longitudinal axis;

a driving rotating member for applying a driving force to the shaft to rotate the conveying rotating member;

a first surface formed on an end of the shaft supporting said conveying rotating member; and a second surface formed on said driving rotating member, wherein each of said first and second surfaces is inclined relative to a plane normal to the axis of said shaft, and driving force is transmitted from said driving rotating member to said shaft through said first and second surfaces.

6. A device according to claim 5, further comprising pushing means for pushing against the other end of said shaft thereby urging said first surface against said second surface.

7. A device according to claim 5, wherein the incline of said first surface begins from a line intersecting the axis of said shaft at the end of the shaft.

8. A sheet conveying device comprising:

a conveying rotating member for providing a sheet with a conveying force by contacting the sheet;

a driving member for applying a driving force to said conveying rotating member;

a first surface rotating around a predetermined rotation axis in synchronization with said conveying rotating member, and inclined relative to a plane normal to said predetermined rotation axis; and a second surface rotating around said predetermined rotation axis in synchronization with said driving member, and inclined relative to a plane normal to said predetermined rotation axis, wherein said driving force is transmitted from said driving member to said conveying rotating member through said first and second surfaces.

9. A device according to claim 8, further comprising pushing means for pushing said first surface against said second surface.

10. A device according to claim 9, wherein said pushing means comprises a spring member for pushing an end of said conveying rotating member opposite to the end on which said first surface is located.

11. A device according to claim 8, wherein a slip between said first rotating member and said driving member occurs when a load operating on said first rotating member exceeds a predetermined value.

* * * * *

UNITED STATES PATENT AND TRADEMARK OFFICE

CERTIFICATE OF CORRECTION

PATENT NO. : 5,161,794

DATED : November 10, 1992

INVENTOR(S) : Nobukazu ADACHI

It is certified that error appears in the above-identified patent and that said Letters Patent is hereby corrected as shown below:

On the title page

[56]
Insert: --*Attorney, Agent or Firm*
Fitzpatrick, Cella, Harper & Scinto--.

COLUMN 1
Line 25, "a" (second occurrence) should be deleted.

COLUMN 2
Line 49, "and" should read --an--.

COLUMN 5
Line 27, "surface" should read --surface,--.

Signed and Sealed this

Seventh Day of December, 1993

*Attest:*

*Attesting Officer*

BRUCE LEHMAN

*Commissioner of Patents and Trademarks*